US005213537A

United States Patent [19]

Roberts et al.

[11] Patent Number: 5,213,537

[45] Date of Patent: May 25, 1993

[54] METHOD FOR DOSING A DISCHARGE LAMP WITH MERCURY

[75] Inventors: Victor D. Roberts, Burnt Hills, N.Y.; James T. Dakin, Shaker Heights, Ohio; Walter R. Champman, Jr., Cleveland Heights, Ohio; Bernard F. Fenoglio, Solon, Ohio

[73] Assignee: General Electric Company, Schenectady, N.Y.

[21] Appl. No.: 904,299

[22] Filed: Jun. 25, 1992

[51] Int. Cl.[5] ..... H01J 9/395

[52] U.S. Cl. ..... 445/53; 445/54

[58] Field of Search ..... 445/9, 10, 16, 26, 39, 445/40, 43, 53, 54, 73; 141/8, 54

[56] References Cited

U.S. PATENT DOCUMENTS

| | | | |
|---|---|---|---|
| 845,670 | 2/1907 | Thomas | 445/54 X |
| 2,311,930 | 2/1943 | Chirelstein | 141/8 |
| 2,730,424 | 1/1956 | Kenty et al. | 445/54 |
| 2,805,689 | 9/1957 | De Groat | 141/66 |
| 4,157,485 | 6/1979 | Wesselink et al. | 445/26 X |
| 4,754,193 | 6/1988 | Holmes et al. | 313/490 |

*Primary Examiner*—Kenneth J. Ramsey
*Attorney, Agent, or Firm*—Jill M. Breedlove; Marvin Snyder

[57] ABSTRACT

After evacuating and cleaning a discharge lamp, such as a fluorescent lamp, the lamp is dosed with mercury in the vapor phase. In particular, mercury vapor is introduced into the lamp at a predetermined pressure such that the vapor contained within the lamp corresponds to the required amount of mercury. To this end, the vapor pressure of mercury is controlled by controlling the temperature of the lamp and a reservoir of mercury in a pre-filled mercury container. Alternatively, a pressure regulator is used to directly control the vapor pressure of mercury at a sufficiently high temperature to maintain at least a portion of the mercury in the vapor state. Still another alternative method involves metering a fixed volume of mercury at a predetermined pressure. Finally, the discharge lamp is dosed with the remaining fill ingredients, e.g., at least one inert gas for a fluorescent lamp. Alternatively, mercury vapor is mixed with the other lamp fill ingredients, and then the mixture is introduced into the lamp according to any of the alternative methods described herein.

18 Claims, 2 Drawing Sheets

METHOD FOR DOSING A DISCHARGE LAMP WITH MERCURY

FIELD OF THE INVENTION

The present invention relates generally to discharge lamps employing mercury as a fill ingredient. More particularly, the present invention relates to a high-precision, high-speed method for dosing a discharge lamp with mercury.

BACKGROUND OF THE INVENTION

Conventional schemes for dosing a discharge lamp with mercury involve directly adding liquid mercury to the arc tube or lamp through an exhaust tube having a narrow diameter. Problems with such mercury dosing schemes occur in the separation and transport of small amounts of mercury into the lamp. Often, for example, droplets of mercury are left in the manufacturing equipment and the exhaust tube. Hence, in order to avoid having an insufficient quantity of mercury in the discharge lamp, the lamp is typically dosed with an excess of mercury. In fluorescent lamps, for example, there is no performance penalty for adding too much mercury because excess mercury resides on the inner surface of the lamp as condensate. An exemplary fluorescent lamp may be dosed with 50 to 100 mg of mercury, even though only 5 to 10 mg are needed for operation over a 20,000 hour life, for example. However, for any type of lamp, there are environmental and cost considerations in using too much mercury. Moreover, for high-pressure mercury and metal halide arc tubes, wherein the entire mercury dose is commonly vaporized during lamp operation, the addition of too much mercury results in an operating voltage that is too high.

Hence, it is desirable to provide a more precise method of dosing discharge lamps with mercury. Unfortunately, greater precision typically results in a slower manufacturing speed and a more complex manufacturing process. For example, mercury drops in the range from 1 to 10 mg have volumes in the range from 0.07 to 0.7 cubic mm, respectively. Such small volumes, in addition to surface tension effects, make measuring and handling the mercury drops difficult.

As described in Holmes U.S. Pat. No. 4,754,193, one method of mercury dosing involves capturing a controlled amount of liquid mercury in a container or a porous carrier prior to lamp or arc tube assembly. The mercury container or carrier is then employed as an internal component of the lamp or arc tube. Although such a method does not require direct measurement or handling of liquid mercury during lamp assembly, it is still complex and costly.

Accordingly, it is desirable to provide a new and improved, high-precision, high-speed method for dosing a discharge lamp with mercury which does not involve direct measurement or handling of liquid mercury.

SUMMARY OF THE INVENTION

After evacuating and cleaning a discharge lamp, such as a fluorescent lamp, the lamp is dosed with mercury in the vapor phase. In particular, mercury vapor is introduced into the lamp at a predetermined pressure such that the vapor contained within the lamp corresponds to the required amount of mercury. To this end, according to one embodiment, the vapor pressure of mercury is controlled by controlling the temperature of the lamp and that of a reservoir of mercury in a pre-filled mercury container. According to another embodiment, a pressure regulator is used to directly control the vapor pressure of mercury at a sufficiently high temperature to maintain at least a portion of the mercury in the vapor state. Still another alternative method of controlling the amount of mercury vapor, and hence the mass of mercury, introduced into the lamp is to meter a fixed volume of mercury at a predetermined pressure.

Finally, the discharge lamp is dosed with the remaining fill ingredients, e.g., at least one inert gas for a fluorescent lamp. Alternatively, mercury vapor is mixed with the other lamp fill ingredients, and then the mixture is introduced into the lamp according to any of the alternative methods described hereinabove.

BRIEF DESCRIPTION OF THE DRAWINGS

The features and advantages of the present invention will become apparent from the following detailed description of the invention when read with accompanying drawings in which.

DETAILED DESCRIPTION OF THE INVENTION

Figure 1:
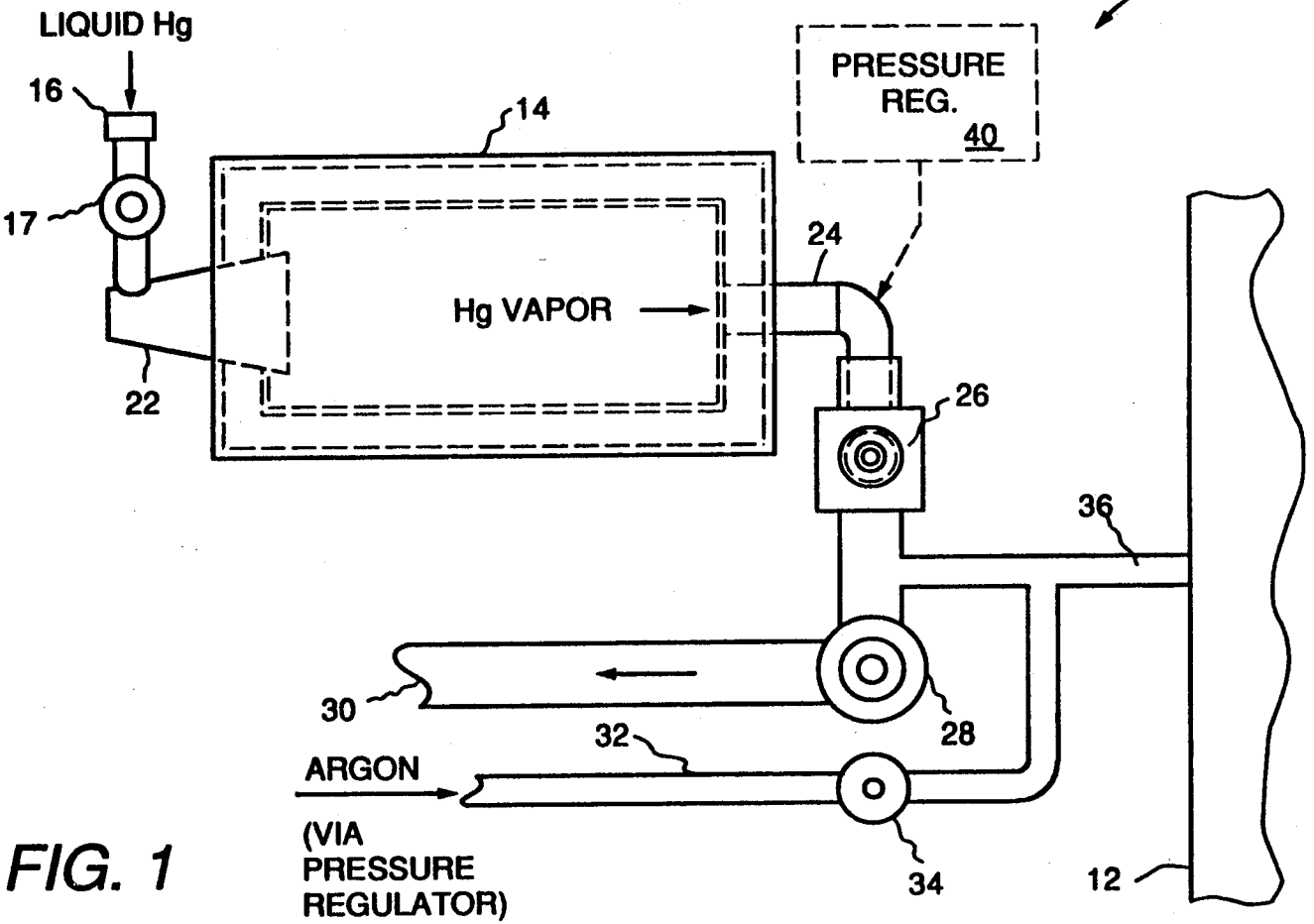
FIG. 1 schematically illustrates suitable apparatus for dosing a discharge lamp with a fill including mercury according to the present invention.

FIG. 1 illustrates apparatus 10 suitable for dosing a discharge lamp with a fill including mercury according to the present invention. By way of example, FIG. 1 shows a portion of a typical fluorescent lamp 12 for receiving such a dose from apparatus 10. A suitable fill for a typical fluorescent lamp includes mercury and at least one inert gas, such as argon, krypton, neon, xenon or other suitable inert gases. Therefore, apparatus 10 will be described herein with respect to a fluorescent lamp having such a fill (e.g., a combination of argon and mercury). However, it is to be understood that the lamp dosing method of the present invention is suitable for dosing any type of discharge lamp having mercury as a fill ingredient.

Lamp dosing apparatus 10 is shown as including a container 14 for containing mercury vapor. A suitable container 14 may comprise, for example, a heat pipe, i.e., a constant-temperature vessel of a type well-known in the art. Although heat pipes are typically used for isothermal processes, it is to be understood that the mercury dosing method of the present invention does not require that the mercury be contained in an isothermal container, as long as the temperature of the coldest spot in the container is maintained at a constant temperature. In particular, the mercury vapor in container 14 will assume a pressure which is in equilibrium with the mercury at the temperature of the coldest spot in the container. Therefore, as long as the temperature of the coldest spot in container 14 is sufficiently high to maintain the mercury vapor at a sufficiently high pressure, the container does not have to be isothermal. Thus, container 14 may simply include a simple thermostatic controller, if desired. Moreover, even though a heat pipe or other thermostatically controlled container is suitable for controlling the mercury pressure, other suitable means for vaporizing the mercury may be used, such as, for example, a pressure regulator for directly controlling the mercury pressure at a sufficiently high temperature, as described hereinbelow.

A mercury fill tube 16, via a valve 17, is coupled to an inlet 22 to container 14. An outlet 24 from container 14 is coupled through a valve 26 to an exhaust tube 36. Exhaust tube 36 is of a conventional type used for dosing discharge lamps. A vacuum valve 28 is provided for regulating a vacuum line 30 for evacuating lamp 12. An argon fill tube 32 is coupled to exhaust tube 36 via a valve 34. Preferably, argon fill tube 32 is connected to a source of argon (not shown) at a fixed pressure, such as a container filled with argon at a high pressure and connected to the respective argon fill tube through a standard pressure regulator, as indicated in FIG. 1.

Initially, lamp 12 is evacuated, via vacuum line 30 and valve 28, and cleaned using conventional methods. According to one embodiment of the present invention, a precise mercury dose is added to the lamp before the lamp is filled with argon. In particular, container 14, from which air is withdrawn, has been pre-filled with liquid mercury through mercury fill tube 16 and valve 17. Inside container 14, the mercury vaporizes and assumes a pressure which is in equilibrium with the liquid mercury at the coldest spot in the container (or, alternatively, the constant temperature of a heat pipe, if used). An exemplary temperature is in the range from approximately 50° C. to 300° C.; and corresponding pressures are in the range from approximately 0.012 Torr to 250 Torr. Valve 26 is opened, allowing mercury vapor to flow into lamp 12 through exhaust tube 36. When a state of equilibrium, i.e.,constant pressure, is reached between lamp 12 and vessel 14, the lamp contains the required amount of mercury. Valve 26 is then closed. Finally, argon is added to the lamp through argon fill-tube 32 via valve 34 and exhaust tube 36.

In order to ensure accurate control of the amount of mercury introduced into lamp 12, the coldest portion of the lamp is maintained at a constant temperature higher than that of the coldest spot of container 14. Additionally, valves 26, 28 and 34 and tubes 24 and 36 are heated to a temperature above that of lamp 12 in order to ensure that no mercury condenses therein; this temperature does not have to be precisely controlled, as long as it is maintained higher than that of the coldest portion of the lamp.

EXAMPLE I

A fluorescent lamp having a length of approximately 48 inches and a diameter of approximately 1½ inches is evacuated and cleaned. Container 14, which has been pre-filled with liquid mercury, is heated such that its coldest spot is at a temperature of approximately 127° C. As a result, a portion of the liquid mercury in container 14 vaporizes to provide mercury vapor at a pressure of approximately 1 Torr. Lamp 12 and all valves and connecting tubes comprising dosing apparatus 10 are maintained at a slightly higher temperature than that of container 14, e.g., 130° C. Valve 26 is opened, allowing mercury vapor to flow from container 14 into lamp 12 via exhaust tube 36. At equilibrium, valve 26 is closed, and the lamp contains approximately 10 mg of mercury.

As an alternative embodiment, instead of controlling the vapor pressure of the mercury by controlling the temperature thereof as described hereinabove, the vapor pressure of mercury is controlled, e.g., as by a pressure regulator 40 of a conventional type, indicated in phantom in FIG. 1, at a sufficiently high temperature to maintain at least a portion of the mercury therein in a vapor state at the predetermined pressure.

According to another alternative embodiment, mercury vapor pressure and flow rate and valve timing are used to control the mercury dose. Container 14 is pre-filled with liquid mercury through mercury fill tube 16 and valve 17. Inside the container, the mercury vaporizes and reaches a predetermined pressure by controlling temperature, as described hereinabove. Mercury vapor is allowed to flow through valve 26, through exhaust tube 36, and into lamp 12 for a predetermined amount of time, after which valve 26 is closed. Lamp 12 thus contains a precise mercury dose. At higher pressures, mercury vapor flows faster; hence, the valves are opened for a shorter time. Finally, after the lamp is dosed with mercury, argon is added to the lamp through argon fill tube 32 and valve 34.

EXAMPLE II

A fluorescent lamp having a length of approximately 48 inches and a diameter of approximately 1½ inches is evacuated and cleaned. Container 14, which has been pre-filled with liquid mercury, is heated to a temperature of approximately 210° C. As a result, a portion of the liquid mercury in container 14 vaporizes to provide mercury vapor at a pressure of approximately 23.7 Torr. Valve 26 is opened for approximately 0.4 sec, allowing mercury vapor to flow from container 14 into lamp 12 via exhaust tube 36. The lamp is thus dosed with approximately 12 mg of mercury. Finally, the lamp is filled with approximately 2.0 Torr-liters of argon via argon fill tube 32 and valve 34.

Figure 2:
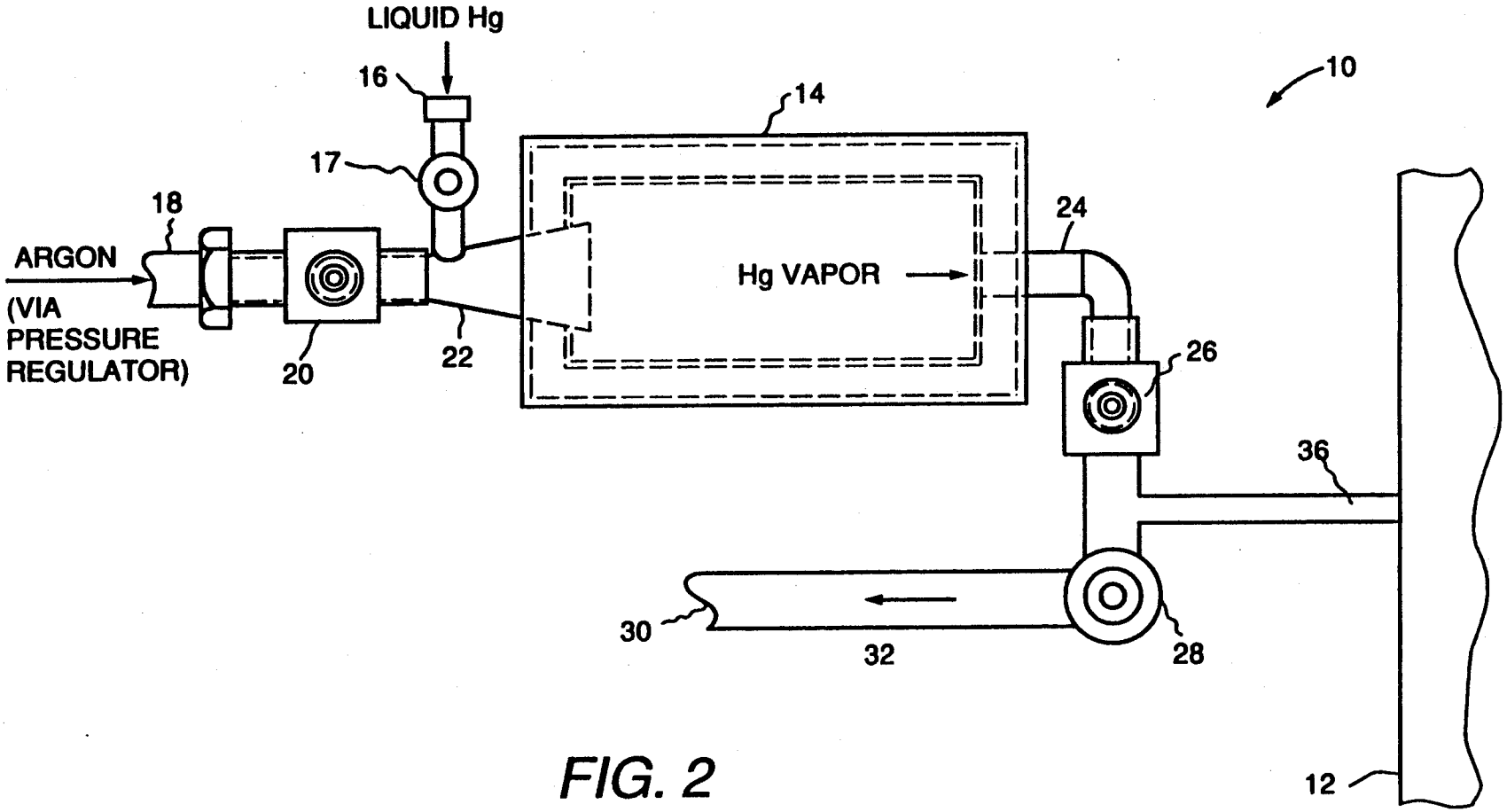
FIG. 2 schematically illustrates suitable apparatus for dosing a discharge lamp with a fill including mercury according to an alternative embodiment of the present invention.

FIG. 2 illustrates an alternative embodiment of apparatus useful for dosing a lamp with mercury wherein the mercury vapor dose and argon are added to the lamp as a mixture. In particular, container 14 is pre-filled with liquid mercury via mercury fill tube 16 and is connected to a source of argon at a fixed pressure via argon fill tube 18. Container 14 is heated such that the mercury vaporizes and mixes with the argon. The temperature of the coldest spot in container 14 determines the pressure of the mercury vapor. The argon-mercury mixture is allowed to flow into exhaust tube 36, and hence lamp 12, through valve 26. When a state of equilibrium is reached, valve 26 is closed, and the lamp is filled with a predetermined amount of mercury and argon.

EXAMPLE III

A fluorescent lamp having a length of approximately 48 inches and a diameter of approximately 1½ inches is evacuated and cleaned. Container 14, which has been pre-filled with liquid mercury and connected to a source of argon at a fixed pressure of approximately 4.25 Torr, is heated such that its coldest spot is at a temperature of approximately 127° C. As a result, a portion of the liquid mercury in container 14 vaporizes to provide mercury vapor at a pressure of approximately 1 Torr. Lamp 12 and all valves and connecting tubes comprising dosing apparatus 10 are maintained at a slightly higher temperature than that of container 14, e.g., 130° C. Valve 26 is opened, allowing the mixture of mercury vapor and argon gas to flow from container 14 into lamp 12 via exhaust tube 36. At equilibrium, valve 26 is closed, and the lamp contains approximately 10 mg of mercury and approximately 3.25 Torr of argon. After the lamp cools to approximately 25° C., it contains approximately 10 mg of mercury and approximately 2.4 Torr of argon.

In similar fashion as described hereinabove, mercury vapor pressure and flow rate and valve timing are used to control the mercury dose in the system of FIG. 2, i.e., wherein the mercury dose and argon are added to the lamp as a mixture. In particular, container 14 is filled with liquid mercury and argon gas via mercury fill tube 16 and argon fill tube 18, respectively. Within the container, the mercury vaporizes and mixes with the argon. The temperature of the coldest spot in the container determines the pressure of the mercury vapor. The argon-mercury mixture is allowed to flow into exhaust tube 36, and hence lamp 12, through valve 26 for a predetermined amount of time, thereby precisely controlling the mercury and argon dose.

EXAMPLE IV

A fluorescent lamp having a length of approximately 48 inches and a diameter of approximately 1½ inches is evacuated and cleaned. Container 14, which has been pre-filled with argon and liquid mercury, is heated to a temperature of approximately 210° C. As a result, a portion of the liquid mercury in container 14 vaporizes to provide mercury vapor at a pressure of approximately 23.7 Torr; while the argon is regulated at a pressure of approximately 50.25 Torr. Valve 26 is opened for approximately 0.1 sec, allowing the mixture of mercury vapor and argon gas to flow from container 14 into lamp 12 via exhaust tube 36. The lamp is thus dosed with approximately 12 mg of mercury and argon at a pressure of approximately 2.6 Torr.

While the preferred embodiments of the present invention have been shown and described herein, it will be obvious that such embodiments are provided by way of example only. Numerous variations, changes and substitutions will occur to those of skill in the art without departing from the invention herein. Accordingly, it is intended that the invention be limited only by the spirit and scope of the appended claims.

What is claimed is:

1. A method for dosing a discharge lamp with a lamp fill including mercury and at least one additional fill ingredient, comprising the steps of:

evacuating the discharge lamp;

establishing a supply of mercury vapor at a predetermined pressure;

mixing the mercury vapor with the additional fill ingredient;

allowing the mixture of mercury vapor and the additional fill ingredient to flow into the discharge lamp until a state of equilibrium is established wherein a predetermined quantity of mercury and a predetermined quantity of the additional fill ingredient are contained within the lamp.

2. The method of claim 1 wherein the predetermined pressure of mercury vapor is established by heating mercury to a predetermined temperature.

3. The method of claim 1 wherein the predetermined pressure of mercury vapor is established by using a pressure regulator to directly control mercury vapor pressure.

4. The method of claim 1 wherein the discharge lamp is a fluorescent lamp, and the additional fill ingredient includes at least one inert gas.

5. The method of claim 4 wherein the inert gas is selected from the group consisting of argon, krypton, neon and xenon, including mixtures thereof.

6. A method for dosing a discharge lamp with mercury, comprising the steps of:

evacuating the discharge lamp;

establishing a supply of mercury vapor at a predetermined pressure; and allowing the mercury vapor to flow into the discharge lamp through a metering system for a predetermined amount of time, said metering system controlling the amount of mercury in the lamp.

7. The method of claim 6 wherein the predetermined pressure of mercury vapor is established by heating mercury to a predetermined temperature.

8. The method of claim 6 wherein the predetermined pressure of mercury vapor is established by using a pressure regulator to directly control mercury vapor pressure.

9. A method for filling a discharge lamp with a lamp fill including mercury, comprising the steps of:

evacuating the discharge lamp;

establishing a supply of mercury vapor at a predetermined pressure;

allowing the mercury vapor to flow into the discharge lamp through a metering system which controls the amount of mercury in the lamp, said metering system allowing the mercury vapor to flow into the lamp for a predetermined time; and dosing the discharge lamp with at least one additional fill ingredient.

10. The method of claim 9 wherein the predetermined pressure of mercury vapor is established by heating mercury to a predetermined temperature.

11. The method of claim 9 wherein the predetermined pressure of mercury vapor is established by using a pressure regulator to directly control mercury vapor pressure.

12. The method of claim 9 wherein the discharge lamp is a fluorescent lamp, and the additional fill ingredient includes at least one inert gas.

13. The method of claim 12 wherein the inert gas is selected from the group consisting of argon, krypton, neon and xenon, including mixtures thereof.

14. A method for dosing a discharge lamp with a lamp fill including mercury and at least one additional fill ingredient, comprising the steps of:

evacuating the discharge lamp;

establishing a supply of mercury vapor at a predetermined pressure;

mixing the mercury vapor with the additional fill ingredient; and allowing the mixture of mercury vapor and the additional fill ingredient to flow into the discharge lamp through a metering system for a predetermined time in order to control the respective amounts of the mercury and the additional fill ingredient therein.

15. The method of claim 14 wherein the predetermined pressure of mercury vapor is established by heating mercury to a predetermined, temperature.

16. The method of claim 14 wherein the predetermined pressure of mercury vapor is established by using a pressure regulator to directly control mercury vapor pressure.

17. The method of claim 14 wherein the discharge lamp is a fluorescent lamp, and the additional fill ingredient includes at least one inert gas.

18. The method of claim 17 wherein the inert gas is selected from the group consisting of argon, krypton, neon and xenon, including mixtures thereof.

* * * * *